US009080783B2

(12) United States Patent
Fincher

(10) Patent No.: US 9,080,783 B2
(45) Date of Patent: Jul. 14, 2015

(54) PNEUMATIC ENERGY SAVING CONTROL

(76) Inventor: George Allen Fincher, Discovery Bay, CA (US)

( * ) Notice: Subject to any disclaimer, the term of this patent is extended or adjusted under 35 U.S.C. 154(b) by 960 days.

(21) Appl. No.: 12/264,844

(22) Filed: Nov. 4, 2008

(65) Prior Publication Data

US 2009/0302249 A1 Dec. 10, 2009

Related U.S. Application Data

(60) Provisional application No. 60/986,664, filed on Nov. 9, 2007.

(51) Int. Cl.
*F16K 31/02* (2006.01)
*F16K 31/64* (2006.01)
*F24F 11/00* (2006.01)

(52) U.S. Cl.
CPC ..... *F24F 11/0012* (2013.01); *F24F 2011/0068* (2013.01)

(58) Field of Classification Search
CPC ..... F24F 11/0012; F24F 11/08; F24F 2011/0068; G05D 23/1934; G05D 16/2093; G05D 23/27524; G05B 2219/2638; G05B 2219/41309
USPC ..... 251/129.04, 14; 137/357, 358
See application file for complete search history.

(56) References Cited

U.S. PATENT DOCUMENTS

| | | | | |
|---|---|---|---|---|
| 4,243,174 | A * | 1/1981 | Moeller et al. | 236/46 R |
| 4,742,956 | A * | 5/1988 | Zelczer | 236/46 R |
| 5,114,070 | A * | 5/1992 | Lilja et al. | 236/49.3 |
| 5,533,668 | A * | 7/1996 | Erikson | 236/49.3 |
| 5,538,036 | A * | 7/1996 | Bergamini et al. | 137/552 |
| 5,810,245 | A * | 9/1998 | Heitman et al. | 236/49.3 |
| 6,691,724 | B2 * | 2/2004 | Ford | 137/1 |
| 6,860,288 | B2 * | 3/2005 | Uhler | 137/552 |
| 6,945,274 | B1 * | 9/2005 | Davis | 137/624.11 |
| 7,058,542 | B2 * | 6/2006 | Hauhia et al. | 702/183 |

* cited by examiner

*Primary Examiner* — Marina Tietjen
*Assistant Examiner* — Seth W Mackay-Smith

(57) ABSTRACT

The objective of the invention is to bypass the existing pneumatic thermostats/controllers providing on off auto operation for VAV boxes, reheat coils, classroom unit ventilators, fan coil units, fin tube radiators, damper actuator's, water control valves and the like, with a remotely controlled three way valves and wireless controlled and self-contained power.

17 Claims, 2 Drawing Sheets

Pneumatic Energy Saving Control
PESC-F100 ecWizard

PNEUMATIC ENERGY SAVING CONTROL

TECHNICAL FIELD

The present invention relates to a pneumatic energy savings control that provides a pneumatic on off auto sequence to existing or new pneumatic control system. The invention is comprised three-way pneumatic switching valves; power supply; wireless room sensor, supply air sensor; and or any pressure temperature or humidity sensing.

BACKGROUND OF THE INVENTION

Pneumatic thermostats are often used to control heating and cooling devices which in turn control the environment where the pneumatic thermostat is located.

SUMMARY OF THE INVENTION

The invention includes a pneumatic thermostat by-pass control device comprising: (i) a wireless communication module for receiving signals from a control computer; and (ii) a pneumatic valve switching module in communication with the communication module, wherein the valve switching module comprises a pneumatic input, a pneumatic output and a switching valve, wherein said pneumatic input and said pneumatic output are in pneumatic communication with the switching valve and the pneumatic input is configured to be in pneumatic communication with a pneumatic thermostat and the pneumatic output is configured to be in pneumatic communication with a pneumatically controlled environmental control device. In response to a wireless signal from the control computer, the communication module sends an output signal to the pneumatic valve switching module. In response to the output signal, said pneumatic valve switching module changes the position of the switching valve.

The invention also includes a pneumatic thermostat by-pass control system comprising: (a) a control computer capable of receiving an environmental input signal from a device located in a space within a building and sending a wireless output signal based on said input signal; (b) a pneumatically controlled environmental control device for controlling the environment in said space; and (c) a pneumatic thermostat by-pass control device. The pneumatic thermostat by-pass control device comprises (i) a wireless communication module for receiving signals from the control computer; (ii) a pneumatic valve switching module in communication with the communication module. The valve switching module comprises a pneumatic input, a pneumatic output and a switching valve, wherein the pneumatic input and the pneumatic output are in pneumatic communication with the switching valve and the pneumatic input is in pneumatic communication with a pneumatic thermostat and the pneumatic output is in pneumatic communication with the pneumatically controlled environmental control device; The by-pass control device also includes a source of electrical power connected to the wireless communication module and the pneumatic valve switching module. In response to the wireless signal from the control computer, the communication module sends an input signal to the pneumatic valve switching module. In response to the input signal, the pneumatic valve switching module changes the position of the switching valve to send a pneumatic output signal to the pneumatically controlled environmental control device to control the environment in the space.

BRIEF DESCRIPTION OF THE DRAWINGS

In FIG. 1, 1 is computer and/or controller w/ software for scheduling each device (PESC-F100); 2 is a wireless input and output information and commands; 3 is a communication input, output and switching valve commands; 4 is a battery for communications (3) pneumatic switching valves; 5 is a static pressure input to battery charging component; 6 are high and low static pressure inputs utilizing tubing; 7 is a CFM cubic feet per minute to communications hub of invention; 8 is a room sensor with battery mounted on a wall or placed on a desk utilizing existing power and communication opportunities from the desk location; 9 are auxiliary inputs hardwired; 10 is hardwired or wireless supply air temperature sensor; 11 are auxiliary inputs wireless; 12 is battery power to pneumatic switching valves; 13 are communication commands to switching valves; 14 is on-off-auto pneumatic pressure to controlled device (cooling); 15 is existing or new pneumatic thermostat or controller; 16 is branch/control line connected to invention (PESC-F100); 17 is pneumatic switching valve section 2-way and/or 3-way valves; 18 is on-off-auto pneumatic pressure to controlled device (heating); 19 is pneumatic main supply air input; 20 is pneumatic exhaust ports (heating); 21 is pneumatic exhaust ports (cooling) and 22 is manual on off auto switches for testing purposes.

In FIG. 2, 1 is branch/control line connected to invention (PESC-F100); 2 is cooling auto-on-off (pneumatic/motorized/solenoid) switching valve; 3 is cooling auto-on-off (pneumatic/motorized/solenoid) switching valve; 4 is on-off-auto pneumatic pressure to controlled device (cooling); 5 is heating auto-on-off (pneumatic/motorized/solenoid) switching valve; 6 is heating auto-on-off (pneumatic/motorized/solenoid) switching valve; 7 is on-off-auto pneumatic pressure to controlled device (heating); 8 is pneumatic main supply air input; 9 is pneumatic exhaust ports (cooling) and 10 is Pneumatic exhaust ports (heating).

DETAILED DESCRIPTION

Figure 1:
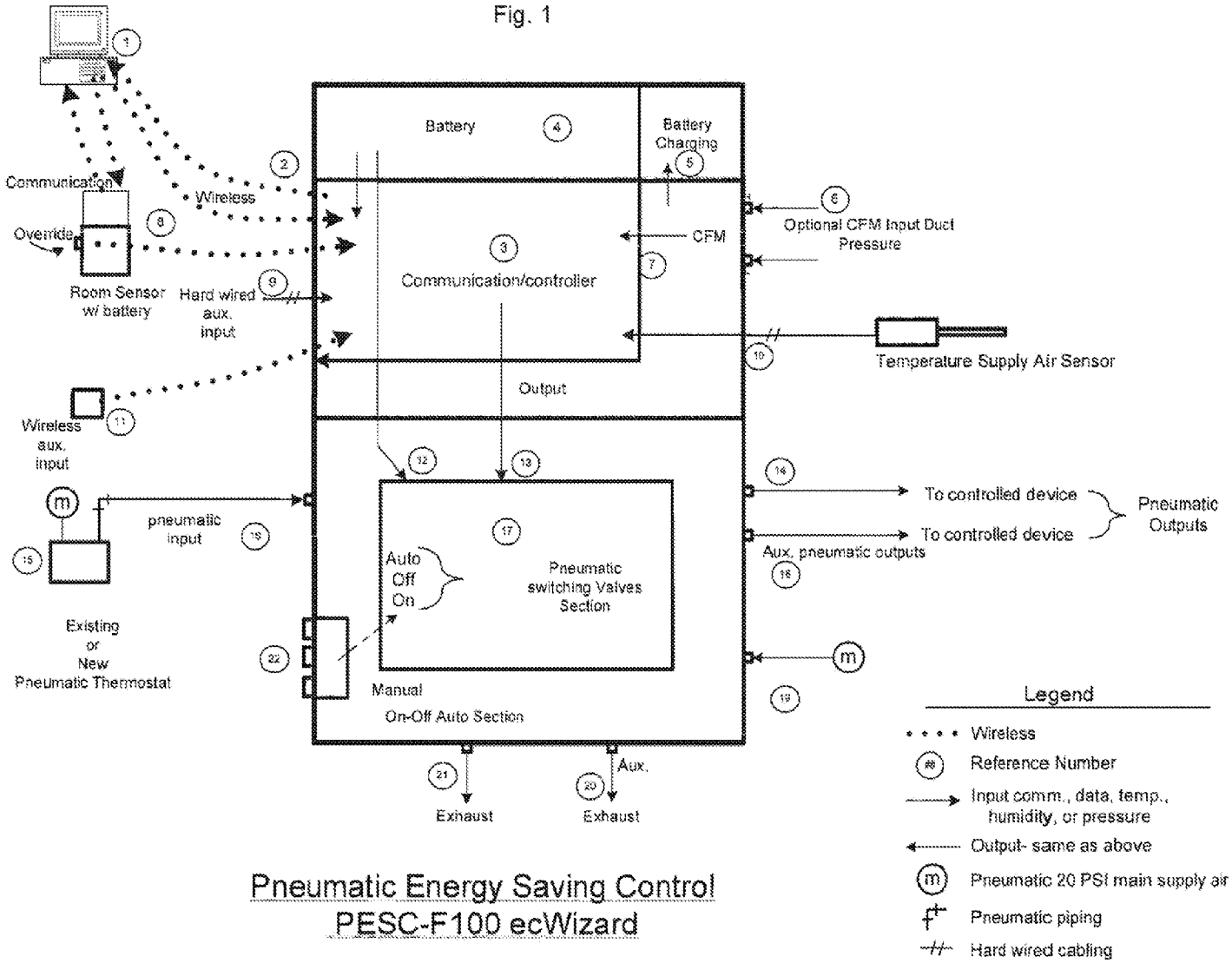
FIG. 1 depicts a pneumatic thermostat by pass device in pneumatic communication with a pneumatic thermostat 15 and environmental control devices.
Figure 2:
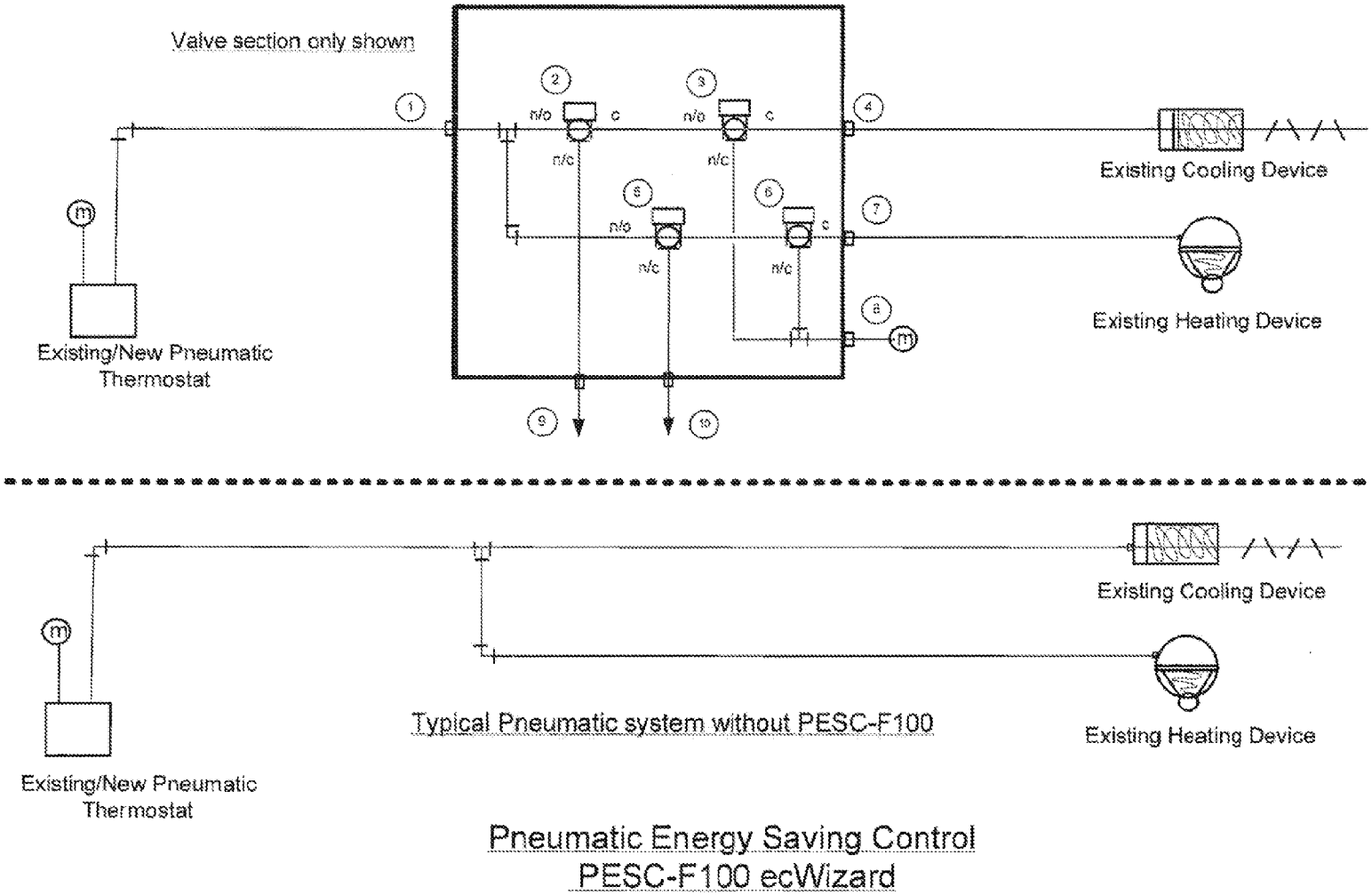
FIG. 2 depicts an existing/new pneumatic thermostat and a pneumatic thermostat where the valve section of the pneumatic thermostat by pass device is shown in pneumatic communication with the pneumatic thermostat.

The invention is directed to bypass the existing or new pneumatic thermostats/controllers providing on off auto operation for VAV boxes, reheat coils, unit ventilators, fan coil units, fin tube radiators, damper actuator's, water control valves and the like, with a remotely controlled three way valves and wireless controlled and self-contained power. Pneumatic thermostats are simple and proven reliable. Pneumatic damper actuators and valve actuators consists of a diaphragm and a spring complementing the pneumatic thermostat with economical and reliable control. A typical installation for this invention would be to install the device in the ceiling next to the VAV terminal box. Room temperature, supply air temperature, motion and/or light detector input and supply air volume (CFM) would be in information inputs to the invention. A remote computer would be capable of monitoring input information and sending output signals to place the invention into one of three modes: on/off/auto.

The invention provides for the following sequences by overriding/bypassing with on off auto pneumatic switching valves:

(1) Individual schedules for each pneumatic thermostatically controlled zone. (Unoccupied/override off, override on or auto.)

(2) Pushbutton or computer generated timed override for after hour occupancy.

(3) Temperature setpoint limitations preventing the pneumatic thermostat from extreme setpoint conditions. Motion and/or light detector input (occupancy) to limit temperature setpoints in unoccupied periods. Providing for override data logging for tenant billing opportunities.

(4) Provide room temperature, motion and/or light detector input, supply air temperature and supply air volume monitoring.

(5) Provide alarms base on various input conditions.

(6) The fail safe sequence would place the invention into auto mode allowing the pneumatic thermostat to control.

(7) Provide battery charging and battery condition information.

Typically the room temperature sensor will be located on a desk closest to the pneumatic thermostat or wall mounted. The sensor will be combined with a communication node and be the hub of communications between the remote computer and the invention located in the ceiling. The desktop/wall mounted sensor/communication node would be able to utilize all of the communications capabilities, existing networks and power located next to a typical desk.]

It is the object; feature an advantage of the present invention to provide on off auto pneumatic switching of new or existing pneumatic thermostats or controls.

It is the object; feature an advantage of the present invention to provide the ability to override existing/new pneumatic thermostats or controls without requiring wiring for an external power source.

It is the object feature an advantage of the present invention to provide a convenient ceiling mounted control bypass with an internal power source.

It is the object; feature an advantage of the present invention to provide bypass switching on and off auto of existing or new controls using wireless communications and remote control.

It is the object feature an advantage of the present invention to provide a means of switching on and off auto which uses new or existing pneumatic air piping to control pneumatically actuated devices.

It is the object, feature an advantage of the present invention to provide on off auto control of new or existing pneumatic thermostats or controllers and have input capabilities to monitor room temperatures, supply air temperatures, supply air cubic feet per minute, heating temperatures, cooling temperatures, humidity, pressure, lighting by means of hardwiring or wireless communications of any type.

It is the object, feature an advantage of the present invention to provide on off auto control of new or existing pneumatic thermostats or controllers comprising of an air inlet from the pneumatic thermostat/controller, a main air supply inlet, two or more exhaust air outlets and two or more air outlets to the controlled devices.

It is the object, feature an advantage of the present invention to provide on off auto control of new or existing pneumatic thermostats or controllers self-contained power supply capable of being recharged utilizing ductwork static pressure.

The present invention provides a method of bypassing the existing or new pneumatic controls that are controlling pneumatic devices. Capable of communicating with wireless modules and receiving wireless commands.

Capable of communicating with hardwired modules and receiving hardwired commands.

What is claimed is:

1. A pneumatic thermostat by-pass control device comprising:

(i) a wireless communication module for receiving wireless on/off/auto output signals from a control computer; and (ii) a pneumatic valve switching module in communication with said communication module, wherein said valve switching module comprises a first pneumatic input, a first pneumatic output and a first switching valve, wherein said first pneumatic input and said first pneumatic output are pneumatically connected to said first switching valve, wherein said first pneumatic input is configured to be pneumatically connected to a pneumatic thermostat and wherein said first pneumatic output is configured to be pneumatically connected to a pneumatically controlled environmental control device;

a second pneumatic input, a second pneumatic output and a second switching valve, wherein said second pneumatic input and said second pneumatic output are configured to be pneumatically connected to a main air supply and said second pneumatic output is configured to be pneumatic communication with the pneumatically controlled environmental control device;

wherein, in response to said wireless on/off/auto output signal from said control computer, said communication module sends an input signal to said pneumatic valve switching module; and wherein in response to said input signal, said pneumatic valve switching module changes the position of said first or second switching valves to send a pneumatic output signal to said pneumatically controlled environmental control device.

2. The device of claim 1 further comprising (iii) a battery connected to said wireless communication module and said pneumatic valve switching module.

3. The device of claim 2 further comprising a battery charger adapted to be powered by supply air duct static pressure.

4. The device of claim 1 wherein said switching valves are two way valves.

5. The device of claim 1 wherein said switching valves are three way valves.

6. The device of claim 1 wherein said communication module is adapted to wirelessly receive signals from an environmental sensor.

7. The device of claim 1 wherein said communication module is adapted to receive a signal from a supply air temperature sensor.

8. A pneumatic thermostat by-pass control system comprising:

(a) a control computer capable of receiving an environmental input signal from an environmental sensor associated with a space within a building and sending a wireless on/off/auto output signal based on said environmental input signal;

(b) a pneumatically controlled environmental control device for controlling the environment in said space;

(c) a pneumatic thermostat by-pass control device comprising:

(i) a wireless communication module for receiving said on/off/auto output signal from said control computer, (ii) a pneumatic valve switching module in communication with said wireless communication module, wherein said pneumatic valve switching module comprises a first pneumatic input, a first pneumatic output and a first switching valve, wherein said first pneumatic input and said first pneumatic output are pneumatically connected to said first switching valve, said first pneumatic output is pneumatically connected to said pneumatically controlled environmental control device, and wherein said first pneumatic input is in pneumatic communication with an existing pneumatic thermostat in response to said on/off/auto output signal from said control computer and a second pneumatic input, a second pneumatic output and a second switching valve, wherein said second pneumatic input and said second pneumatic output are pneumatically connected to said second switching valve, said second pneumatic output is pneumatically connected to said pneumatically controlled environmental control device, wherein said second pneumatic input is pneumatically connected to an existing main air supply and wherein said existing main air supply is in pneumatic communication with said environmental control device in response to said on/off/auto output signal from said control computer, (iii) a source of electrical power connected to said wireless communication module and said pneumatic valve switching module;

wherein, in response to said wireless on/off/auto output signal from said control computer, said communication module sends an input signal to said pneumatic valve switching module; and wherein in response to said input signal, said pneumatic valve switching module changes the position of said first or second switching valves to send a pneumatic output signal to said pneumatically controlled environmental control device to control the environment in said space.

9. The system of claim 8 wherein said environmental control device is a heating device.

10. The system of claim 8 wherein said environmental control device is a cooling device.

11. The system of claim 8 wherein said environmental control device is a heating device and a cooling device.

12. The system of claim 8 further comprising a wireless environment sensor in said room or region capable of wirelessly communicating with said communication module.

13. The system of claim 8 further comprising a battery as said source of said electric power to said communication module and said switching module.

14. The system of claim 13 further comprising a battery charger to recharge said battery.

15. The system of claim 14 wherein said battery charger is powered by supply air duct static pressure.

16. The system of claim 8 further comprising a supply air temperature sensor in communication with said communication module.

17. The system of claim 8 wherein said pneumatic thermostat by-pass control device is located in the ceiling of said space.

* * * * *